US011624141B2

(12) United States Patent
Cannon et al.

(10) Patent No.: US 11,624,141 B2
(45) **Date of Patent: *Apr. 11, 2023**

(54) FABRIC TREATING APPLIANCE COMPRISING A BULK DISPENSER

(71) Applicant: WHIRLPOOL CORPORATION, Benton Harbor, MI (US)

(72) Inventors: Marcus A. Cannon, Saint Joseph, MI (US); Bruno T. Ramasco, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 46 days.

This patent is subject to a terminal disclaimer.

(21) Appl. No.: 17/245,086

(22) Filed: Apr. 30, 2021

(65) Prior Publication Data

US 2021/0246596 A1 Aug. 12, 2021

Related U.S. Application Data

(60) Continuation of application No. 16/545,720, filed on Aug. 20, 2019, now Pat. No. 11,028,521, which is a division of application No. 15/634,147, filed on Jun. 27, 2017, now Pat. No. 10,422,069.

(51) Int. Cl.

| | |
|---|---|
| ***D06F 39/02*** | (2006.01) |
| ***D06F 13/00*** | (2006.01) |
| ***D06F 37/12*** | (2006.01) |
| *D06F 23/04* | (2006.01) |
| *D06F 34/30* | (2020.01) |
| *D06F 34/28* | (2020.01) |

(52) U.S. Cl.
CPC ..... *D06F 39/02* (2013.01); *D06F 13/00* (2013.01); *D06F 37/12* (2013.01); *D06F 23/04* (2013.01); *D06F 34/28* (2020.02); *D06F 34/30* (2020.02); *D06F 39/022* (2013.01)

(58) Field of Classification Search
CPC ..... D06F 39/02
See application file for complete search history.

(56) References Cited

U.S. PATENT DOCUMENTS

| | | | |
|---|---|---|---|
| 3,124,271 | A | 3/1964 | Beck et al. |
| 3,757,543 | A | 9/1973 | Braga |
| 4,009,598 | A | 3/1977 | Bernard et al. |
| 5,392,618 | A | 2/1995 | Livingston et al. |
| 6,354,172 | B1 | 3/2002 | Piacenza et al. |
| 7,252,113 | B2 | 8/2007 | Jacobs et al. |
| 7,802,335 | B2 | 9/2010 | Hoppe et al. |
| 8,490,440 | B2 | 7/2013 | Aykroyd et al. |
| 2004/0069325 | A1 | 4/2004 | Cerruti et al. |
| 2006/0117811 | A1 | 6/2006 | Kinnetz |

*Primary Examiner* — Jason Y Ko
(74) *Attorney, Agent, or Firm* — McGarry Bair PC

(57) ABSTRACT

A fabric treating appliance comprising a cabinet defining an interior and having a top wall defining an access opening. A cover movable relative to the cabinet between opened/closed positions to selectively close the access opening. A tub located within the interior and having an upper edge defining an open top, a rotatable basket located within the tub and having an upper edge defining a loading opening. A tank defining a bulk dispensing reservoir positioned in the cabinet, and a timer valve that is fluidly coupled to the bulk dispensing reservoir. A time selector is located on the tank and operably coupled to the timer valve. The time selector has non-time selection indicia such as load amount, liquid volume, or soil level. The timer valve is a mechanical timer valve.

17 Claims, 4 Drawing Sheets

FABRIC TREATING APPLIANCE COMPRISING A BULK DISPENSER

CROSS REFERENCE TO RELATED APPLICATIONS

This application claims priority to and is a continuation of U.S. patent application Ser. No. 16/545,720, filed Aug. 20, 2019, issued as U.S. Pat. No. 11,028,521, on Jun. 8, 2021, which is divisional application of U.S. patent application Ser. No. 15/634,147 filed Jun. 27, 2017, issued as U.S. Pat. No. 10,422,069, on Sep. 24, 2019, both of which are incorporated herein in their entirety.

BACKGROUND OF THE INVENTION

Fabric treating appliances such as washing machines typically operate to clean fabric by placing the fabric in contact with cleaning fluid such as soapy water, and providing relative motion between the clothes and the fluid. Commonly a fabric mover such as an agitator provides mechanical energy to a load of fabric immersed in the cleaning fluid by agitating the load in a manner that both jostles the fabric in the fluid and circulates the fluid through the fabric. A fabric treating appliance for home use can perform a select programmed series of operations on fabric placed in a basket or drum located within the interior of the appliance. The programmed operations can comprise a plurality of steps in a select sequence. One or more dispensers of treating chemistry, such as detergent, fabric softeners, or bleach can be activated manually or automatically at one or more designated points during a programmed cycle of operation.

SUMMARY

One embodiment of the disclosure is a fabric treating appliance comprising a cabinet defining an interior and having a top wall defining an access opening, a cover movable relative to the cabinet between opened/closed positions to selectively close the access opening, a tub located within the interior and having an upper edge defining an open top, a rotatable basket located within the tub and having an upper edge defining a loading opening, a tank defining a bulk dispensing reservoir positioned in the cabinet, a timer valve fluidly coupled to the bulk dispensing reservoir, and a time selector carried by the tank and operably coupled to the timer valve and having non-time selection indicia corresponding to at least one characteristic of load amount, liquid volume, or soil level. The timer valve is a mechanical timer valve and the time selector is an input movably mounted to the tank wherein the physical position of the input sets an activation time for the mechanical timer valve.

DESCRIPTION

Figure 1:
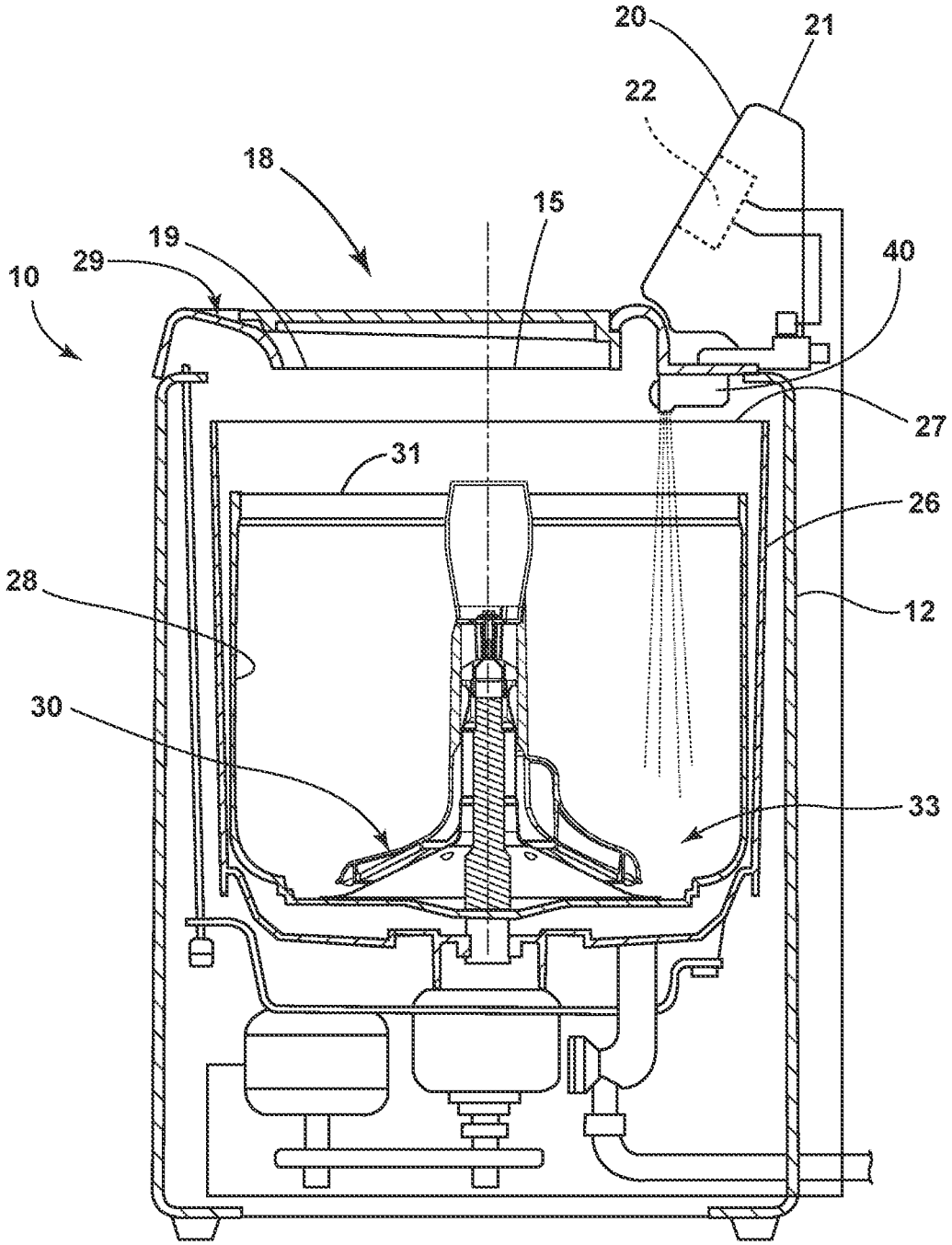
FIG. 1 is a schematic sectional view of a fabric treating appliance in the form of a washing machine.

FIG. 1 is a schematic view of a fabric treating appliance in the form of a vertical axis washing machine 10. The washing machine 10 can include a cabinet 12 defining an interior for housing the operational parts of the washing machine, together with a hinged lid 18. The cabinet can also have a top wall 19 having a shroud 29 provided at the top of the cabinet 12 and defining an access opening 15 which items of clothing or other fabric can pass when placing the fabric items in the washing machine 10 for washing. Housed within the cabinet 12 is a wash tub 26, a basket 28, and an agitator assembly 30. The tub 26 is located within the interior and has an upper edge defining an open top 27 confronting the access opening 15. The tub 26 holds the wash liquid that is used in the operation of the washing machine 10. The basket 28 holds the fabric during operation of the washing machine 10. The basket 28 is located within the tub 26 and has an upper edge defining a loading opening 31 confronting the open top 27 and the access opening 15. The shroud 29 can curve downwards toward a treating chamber 33 to direct fabric items into the basket 28. The shroud 29 can overlie a portion of the tub 26 and basket 28 such that the fabric items do not fall between the basket 28 and the tub 26. A console 21 having a control panel 20 which includes the operating controls 22 for the washer is illustrated on the upper rear of the cabinet 12, but can be located elsewhere.

The washing machine 10 can further comprise a bulk dispenser 40. The bulk dispenser 40 can carry or store treating chemistry such as fabric detergent, fabric softener or bleach for multiple cycles or loads of fabric before needing to be refilled. The bulk dispenser 40 can be located above the open top 27 of tub 26 or the loading opening 31 of the basket 28 and toward the rear of the shroud 29 for convenient user access although other locations can be used as desired. As one of skilled in the art will recognize, the washing machine 10 can comprise multiple bulk dispensers 40 that each hold various treating chemistries or a single partitioned bulk dispenser 40 that is configured to hold and dispense more than one treating chemistry.

Figure 2:
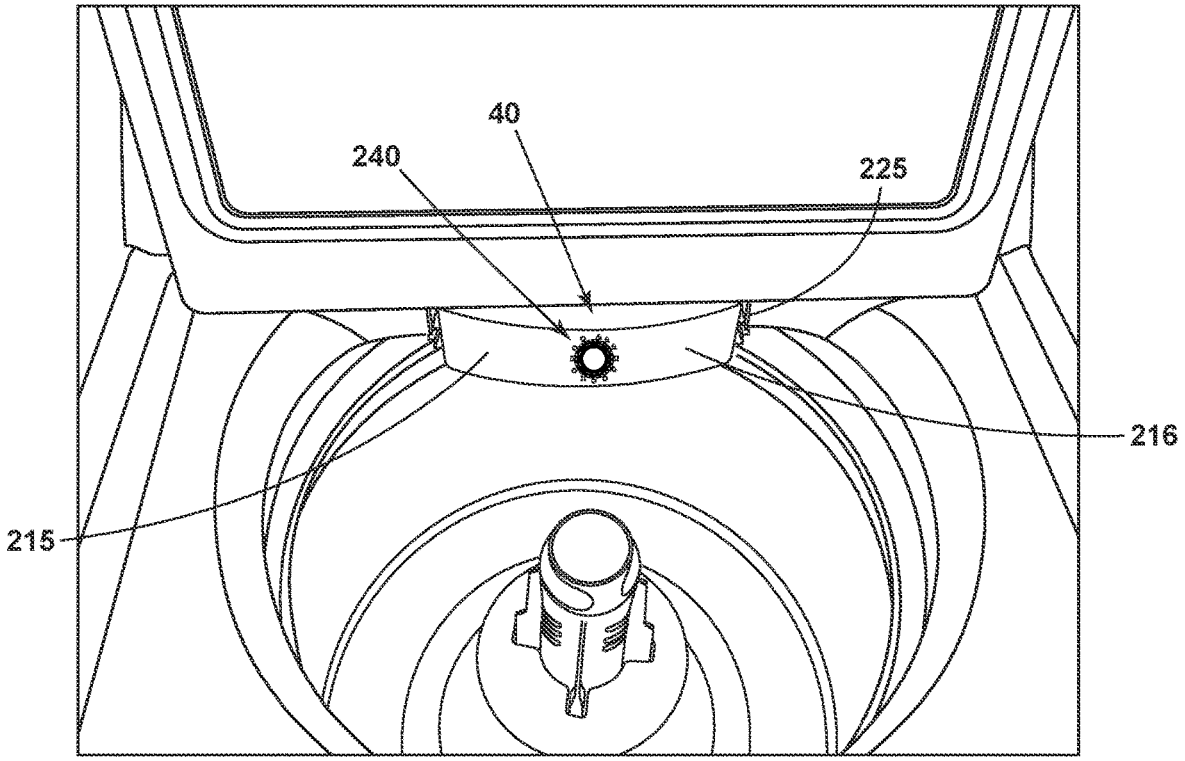
FIG. 2 is a perspective view of the top of an exemplary embodiment showing the location of a bulk dispenser.

FIG. 2 is a perspective view of the top of the fabric treating appliance of FIG. 1 including the bulk dispenser 40. The bulk dispenser 40 can be in the form of a chamber or tank 215 removably mounted to a frame or seat 225, as generally shown. As illustrated, the bulk dispenser 40 is slidable in and out of the seat 225 allowing convenient access to the bulk dispenser 40 for refilling. A time selector 240 is also carried on the tank 215 and acts as a manually operable timer used for controlling the dispensing of treating chemistry from the bulk dispenser 40. The time selector 240 can be positioned on a side wall or face 216 of the tank 215.

Seat 225 can take a multitude of forms, but its primary functionality is to carry bulk dispenser 40. While it is illustrated that seat 225 can provide rails to allow the bulk tank 215 to slide in and out of the washing machine 10, the function of carrying the bulk dispenser 40 could carried out in many ways, without limiting the scope of the disclosure. In a non-limiting embodiment, the seat 225 could also be a dispensing drawer tank commonly found in contemporary clothes washers, making the bulk dispenser suitable for retrofitting a drawer-type dispenser with a removable bulk dispenser, providing easy convertibility between a drawer type system and a bulk dispensing system.

Figure 3:
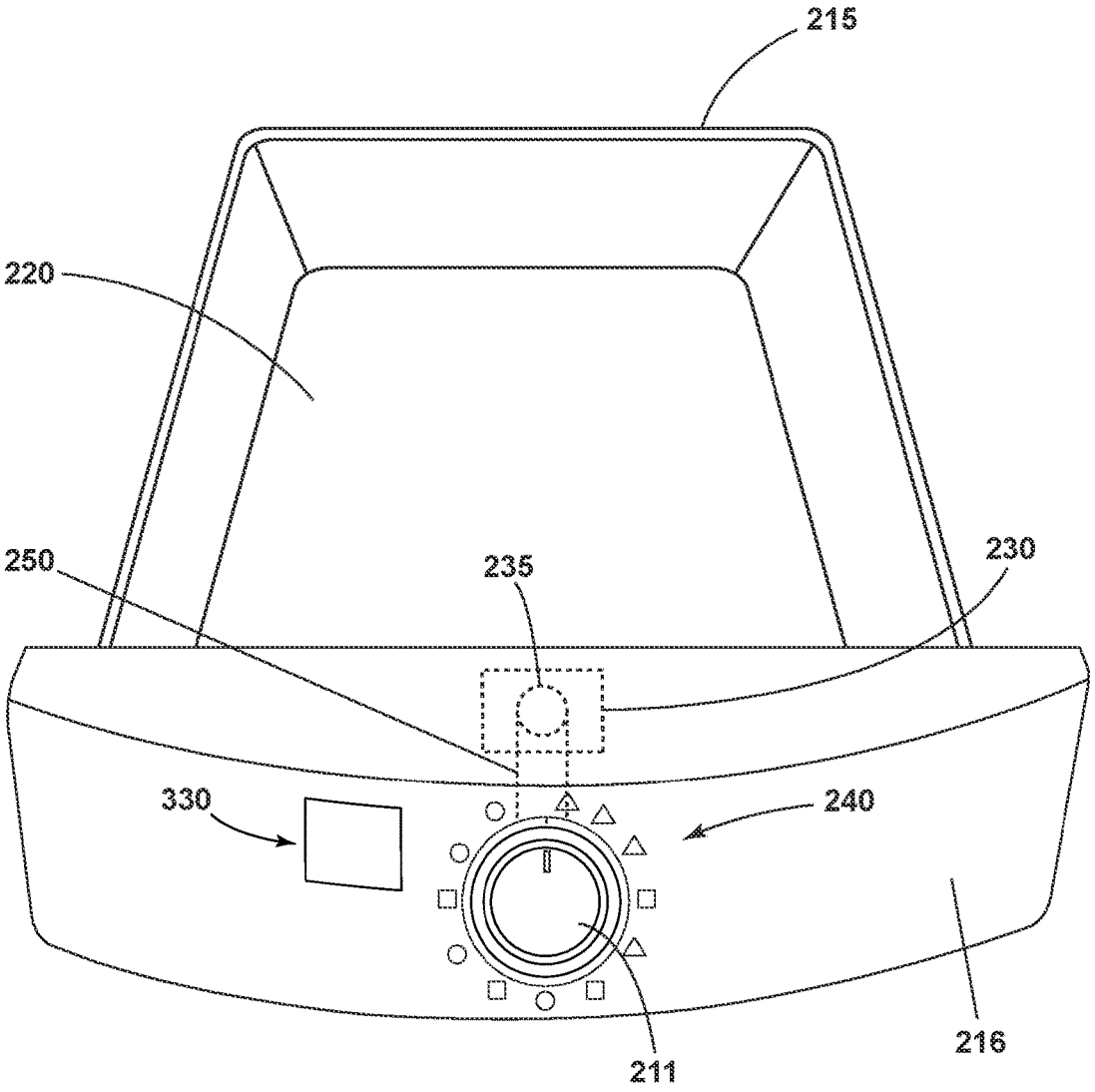
FIG. 3 is a detailed view of the bulk dispenser shown in FIG. 2.

FIG. 3 shows a perspective view of the bulk dispenser 40 removed from the seat 225. The tank 215 defines a bulk dispensing reservoir 220 having an outlet 235. The tank 215 contains a timer valve 230 carried by the tank 215 and can fluidly connect the bulk dispensing reservoir 220 to the outlet 235. The outlet 235 can be positioned above the treating chamber 33, between the basket 28 and the tub 26, or virtually anywhere in the washing machine 10. It is also contemplated that the outlet may dispense to a dispenser with a water inlet to flush detergent into the treating chamber 33 during an appropriate time in the wash cycle.

The timer valve 230 is a mechanical timer valve that opens for a time interval set by the user by turning a dial or knob, such as time selector 240, to a desired time interval. The time selector 240 counts down from the selected time interval. Turning the time selector 240 stores energy in the mainspring (not shown) of the timer selector 230. After setting the time selector 240, the energy is released by the mainspring, which rotates the time selector 240 back to it's at rest position. During the time the time selector 240 is activated, the timer valve 230 is open and will dispense contents in the bulk dispensing reservoir 220 through outlet 235 until the time selector 240 moves back to it's at rest position. It should understood that the timer valve 230 could be located in various locations within or proximate the tank 215 provided the valve is operable controlled by the time selector 240 and remains in fluid communication with the dispensing reservoir 220. Timer values are typically a cost effective alternative to traditional electrical timers.

As discussed, the time selector 240 is an input moveably mounted to the tank 215 where the physical position of the input sets an activation time for the mechanical timer valve 230. The input itself is a rotatable wheel or knob 211. Rotation of the wheel or knob 211 sets the activation time for the timer valve 230. The time selector 240 can be operably coupled to the timer valve 230. For purposes of illustration the coupling or linkage between the time selector and timer valve is shown as element 250. However, it should be noted that combined time selectors and timer valves and mechanical couplings there between are well known in the art. A non-limiting example of a suitable combined time selector and timer valve is disclosed in U.S. Pat. No. 6,354,172 to Piacenza et al., filed Jan. 30, 2000, entitled "Mechanical Timer Mechanism for Valve Control".

In operation, the timer valve 230 can be located inside the tank 215 and is closed, or non-dispensing, when not in use. The knob 211 is configured to be rotated to select a fabric load characteristic, such as a load amount or the size of the load (e.g., small, medium, large), a water level or volume (e.g., low, mid, high), soil level (e.g., low, medium, high) or another scale or combinations of characteristics thereof. A legend 330 maybe provided on the face 216 of the tank 215 to depict the various load characteristics. Based on the selection, the time selector 240 opens the valve 230 for a predetermined amount of time to dispense a corresponding amount of treating chemistry through the outlet 235. In this example, a user simply has to rotate the knob 211 to a desired setting without having to manually add treating chemistry to each load. The user only needs to add treating chemistry to the bulk dispenser 40 after washing multiple loads.

Figure 4:
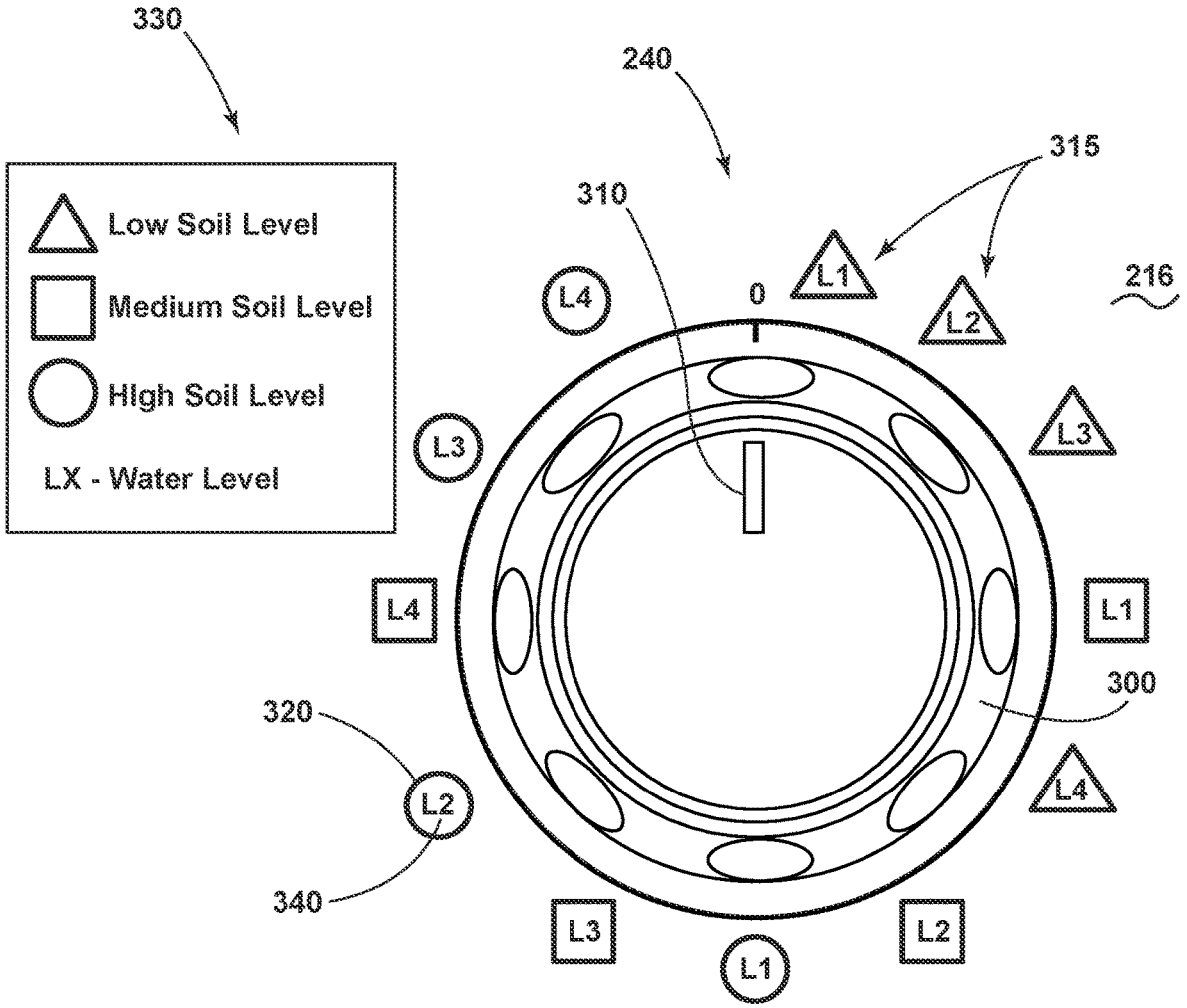
FIG. 4 is an exemplary embodiment of a selector knob consistent with FIG. 2 and FIG. 3.

FIG. 4 is a detailed view of an exemplary embodiment of the time selector 240. As shown, the time selector 240 can have a selector knob 300 with a pointer 310. The time selector 240 can be operated by rotating the selector knob 300 until the pointer 310 points to one of a plurality of selection indicia 315 distributed around the periphery of the selector knob 300 on the face 216 of the tank 215 of the bulk dispenser 40. The indicia 315 can directly indicate time, but in other implementations do not directly indicate time. Rather, the indicia can correspond to at least one characteristic of load amount, liquid volume, or soil level. The further the knob 300 is rotated the longer the time selector 240 will operate. The time selector 240 is operatively linked to the valve 230, which opens when the time selector 240 is set and closes with the time selector 240 expires. A varying amount of treating chemistry can be dispensed simply by turning the selector knob 300 to select one of the indicia 315, thereby opening the timer valve 230 for a corresponding amount of time. In other words, when the timer valve 230 is open, the treating chemistry in the tank 215 is dispensed into the tub 26 or treating chamber 33 or other dispenser housing, and the longer the valve 230 remains open the more treating chemistry is dispensed. Treating chemistry can be fabric detergent, fabric softener, bleach or other fabric chemistry cleaner.

In the exemplary embodiment shown in FIG. 4 each of the indicia 315 comprise two elements. One element consists of the shape of the indicium 320, for which the legend 330 is provided. It is contemplated that the legend 330 can be printed on the face 216 of the tank 215 of the bulk dispenser 40, although it is not required. As shown in the legend 330, a triangle is used to represent a low soil level, a square indicates a medium soil level, and a circle represents a high soil level. The other element is a water level LX, 340, that is, the letter "L" (for "level"), and a digit indicating the water level being selected, from 1 (low) to 4 (high). Other reference symbols, letters, digits and the like can be used. Moreover, other indicia 315 can alternatively or additionally be used, to indicate the same characteristics of the fabric load, or different characteristics, or both.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A fabric treating appliance comprising:

a cabinet defining an interior and having a top wall defining an access opening;

a cover movable relative to the cabinet between opened/closed positions to selectively close the access opening;

a tub located within the interior and having an upper edge defining an open top;

a rotatable basket located within the tub and having an upper edge defining a loading opening;

a tank defining a bulk dispensing reservoir positioned in the cabinet;

a timer valve fluidly coupled to the bulk dispensing reservoir; and a time selector carried by the tank and operably coupled to the timer valve and having non-time selection indicia corresponding to at least one characteristic of load amount, liquid volume, or soil level;

wherein the timer valve is a mechanical timer valve and the time selector is an input movably mounted to the tank wherein the physical position of the input sets an activation time for the mechanical timer valve.

2. The fabric treating appliance of claim 1 further comprising a shroud extending from the cabinet.

3. The fabric treating appliance of claim 2 wherein the tank is carried by the shroud.

4. The fabric treating appliance of claim 1 wherein the tank is fluidly connected to a dispensing outlet.

5. The fabric treating appliance of claim 4 wherein the dispensing outlet is positioned above the tub.

6. The fabric treating appliance of claim 1 wherein the input is rotatably mounted to the tank and the rotational position sets the activation time.

7. The fabric treating appliance of claim 6 wherein the input is at least one of a knob or wheel.

8. The fabric treating appliance of claim 1 wherein the tank comprises a side and the time selector is located on the side.

9. The fabric treating appliance of claim 7 wherein the side is a face.

10. The fabric treating appliance of claim 1 wherein the tank comprises an outlet and the timer valve fluidly connects the tank to the outlet.

11. The fabric treating appliance of claim 10 wherein the timer valve is located within the tank.

12. The fabric treating appliance of claim 1 wherein the dispenser tank has an outlet overlying the loading opening of the basket.

13. The fabric treating appliance of claim 1 wherein the time selector comprises a pointer.

14. The fabric treating appliance of claim 13 wherein the time selector can be rotated to align with one of the non-time selection indicia.

15. The fabric treating appliance of claim 1 wherein the non-time selection indicia are distributed around the periphery of the time selector.

16. The fabric treating appliance of claim 15 wherein the non-time selection indicia comprise a shape.

17. The fabric treating appliance of claim 16 wherein the shape is one of a square, triangle, and circle.

* * * * *